US007624912B2

(12) United States Patent
Churvis

(10) Patent No.: US 7,624,912 B2
(45) Date of Patent: Dec. 1, 2009

(54) THREE-PIECE CONTAINER

(75) Inventor: Michael A Churvis, Germantown, TN (US)

(73) Assignee: International Peper Co.,, Memphis, TN (US)

( * ) Notice: Subject to any disclaimer, the term of this patent is extended or adjusted under 35 U.S.C. 154(b) by 0 days.

(21) Appl. No.: 11/984,000

(22) Filed: Nov. 13, 2007

(65) Prior Publication Data

US 2008/0110964 A1 May 15, 2008

Related U.S. Application Data

(60) Provisional application No. 60/858,977, filed on Nov. 14, 2006.

(51) Int. Cl.
*B65D 5/32* (2006.01)

(52) U.S. Cl. ..... 229/122.24; 229/122.26; 229/191; 229/918

(58) Field of Classification Search ..... 229/122.24, 229/122.26, 191, 918, 919
See application file for complete search history.

(56) References Cited

U.S. PATENT DOCUMENTS

| | | | | |
|---|---|---|---|---|
| 1,974,527 | A | 9/1934 | Bliss | |
| 3,099,379 | A * | 7/1963 | Stease | 229/122.26 |
| 3,335,934 | A * | 8/1967 | Danis | 229/122.24 |
| 4,304,351 | A | 12/1981 | Stollberg | |
| 4,389,013 | A * | 6/1983 | Hall et al. | 229/915 |
| 4,417,686 | A | 11/1983 | Wozniacki | |
| 4,884,739 | A * | 12/1989 | Nederveld | 229/122.24 |
| 5,752,648 | A | 5/1998 | Quaintance | |
| 5,860,590 | A | 1/1999 | Bloomfiel et al. | |
| 5,950,915 | A * | 9/1999 | Moen | 229/122.24 |
| 6,186,393 | B1 * | 2/2001 | Tsamourgelis | 229/122.26 |
| 6,309,335 | B1 | 10/2001 | Holton | |
| 6,598,785 | B2 | 7/2003 | Quaintance | |
| 6,749,107 | B2 | 6/2004 | Quaintance | |
| 6,868,968 | B1 * | 3/2005 | Casanovas | 229/191 |
| 2004/0056081 | A1 * | 3/2004 | Christensen et al. | 229/122.26 |
| 2004/0256448 | A1 * | 12/2004 | Blomfield et al. | 229/918 |
| 2005/0242164 | A1 * | 11/2005 | Teixidor Casanovas | 229/191 |
| 2006/0113363 | A1 * | 6/2006 | Churvis | 229/120.26 |
| 2006/0283926 | A1 * | 12/2006 | Durnin | 229/122.24 |

* cited by examiner

*Primary Examiner*—Gary E Elkins
(74) *Attorney, Agent, or Firm*—Matthew M. Eslami

(57) ABSTRACT

A three-piece container comprises top and bottom walls, apposite end walls, opposite side walls, and reinforced corners. First and second end pieces are configured to form first and second container end walls. The end pieces are each folded to define an inner end wall panel and an overlying outer end wall panel. First partial side wall panels extend perpendicularly from opposite sides of the outer wall panel. Second partial side wall panels are joined to the inner end wall panel by a diagonal web that forms a reinforcing corner post in each corner of the container. A wrapper is configured to be joined to the first and second end pieces and is folded to define the top wall, the bottom wall, and the opposite side walls. The wrapper overlies the partial side wall panels to define a triple wall side wall construction.

8 Claims, 16 Drawing Sheets

THREE-PIECE CONTAINER

FIELD OF THE INVENTION

This invention relates generally to packaging and in particular to a modified Bliss-style shipping container of simplified construction and enhanced stiffness and rigidity.

BACKGROUND OF THE INVENTION

Various styles of shipping containers are known in the prior art, including the so-called Bliss-style container in which a wrapper is folded around and stapled or glued to a pair of end pieces to form an enclosed container. The end pieces normally comprise flat panels that form the end walls in the container, and the wrapper forms the bottom wall, sidewalls and top wall. Flanges on opposite edges of the wrapper are folded and glued or otherwise fastened to the end wall panels to secure the wrapper and end pieces together. The flanges fastened against the end wall panels in the corners of the container serve to strengthen the container in comparison to a typical box that is folded from a single blank and has single panel thickness in the end walls and sidewalls. Compression or stacking strength of the container normally is enhanced by orienting the corrugations of the wrapper so that they extend vertically, but this sometimes results in inefficient utilization of corrugator width during manufacture of the container.

Another common style of shipping container is the so-called Defor container made by International Paper Company. The Defor container typically is formed from a single blank that is folded to form double thickness end walls and/or sidewalls and therefore normally has greater strength than a Bliss-style container, although it requires more material in its manufacture. Stacking tabs normally project from the upper edges of the end walls or sidewalls and notches in the lower edges receive the stacking tabs when two or more containers are stacked on top of one another. One of the panels forming a part of the end walls or sidewalls can be folded to form a diagonal panel in each corner to lend greater stacking strength to the container.

Some Bliss-style containers have modified corners wherein a diagonal corner panel extends across each corner to increase the stacking strength, but in these conventional modified corner Bliss-style containers there is nothing behind the angled panel except the edge of the wrapper and the wrapper flange that is secured to the end panel. Moreover, in these conventional modified corner designs the flanges on the wrapper must be relatively wide to reach past where the diagonal corner panel joins the end panel. This results in weak areas in the bottom of the container at each corner.

SUMMARY OF THE INVENTION

The shipping container of the present invention has features of both the Bliss-style container and the Defor container, but has advantages possessed by neither of them. The container of the invention is formed from three pieces, including a wrapper secured to two end pieces. The end pieces are uniquely constructed so that a double wall lamination is created in each end wall and a triple wall lamination is created in each sidewall of the assembled package, allowing very high compression levels to be achieved from the use of relatively lightweight materials. Further, the design creates an actual full corner post in all four corners, versus simply creating a diagonal panel in each corner as done in prior art constructions noted above. In the present design the end piece is made so that when it is folded into operative relationship there is an additional 90 degree corner that is glued in the 90 degree corner created by the flanges of the wrapper. This design also enables use of a shorter flange on the wrapper because the flanges do not have to extend past the point where the diagonal panel ends. In addition, the design of the invention eliminates weak areas in the bottom of the container at each corner since the flanges of the wrapper originate from the corner of the package rather than originating from the inset distance of the diagonal corner as in traditional Bliss modified corner packages. Still further, the design of the invention enables the corrugations in the wrapper to be oriented horizontally since compression strength is obtained primarily from the end structures, allowing efficient and optimized utilization of corrugator width during manufacture of the container. The overall structure also is stiffer and more rigid than conventional packages due to the spanning of the entire width of the package by the end panels, while still providing a modified corner to reduce package nesting in stacked configuration.

Accordingly, one aspect of the present invention relates to a three-piece container comprising top and bottom walls, opposite end walls, opposite side walls, and reinforced corners. A first end piece is configured to form a first container end wall. The first end piece is folded to define an inner end wall panel and an overlying outer end wall panel. The inner end wall panel is foldably joined to a bottom edge of the outer end wall panel. First partial side wall panels extend perpendicularly from opposite sides of the outer end wall panel, and second partial side wall panels are joined to opposite sides of the inner wall panel by a diagonal web or corner panel that forms a reinforcing corner post in each corner of the container. The second partial side wall panels extend perpendicularly to the inner end wall panel. A second end piece is configured to form a second container end wall. The second end piece is folded to define an inner end wall panel and an overlying outer end wall panel. The inner end wall panel is foldably joined to a bottom edge of the outer end wall panel. First partial side wall panels extend perpendicularly from opposite sides of the outer end wall panel, and second, partial side wall panels are joined to opposite sides of the inner wall panel by a diagonal web or corner panel that forms a reinforcing corner post in each corner of the container. The second partial side wall panels extend perpendicularly to the inner end wall panel. A wrapper is configured to be joined to the first and second end pieces and is folded to define the top wall, the bottom wall, and the opposite side walls. The wrapper overlies the partial side wall panels to define a triple wall side wall construction.

Another aspect of the present invention relates to a blank for making an end piece for a three-piece container. The three-piece container comprises an outer end wall panel. First partial sidewall panels are foldably joined to opposite ends of the outer end wall panel. An inner end wall panel is foldably joined along a bottom edge of the outer end wall panel. Reinforcing corner panels are foldably joined to opposite ends of the inner end wall panel, and second partial sidewall panels are foldably joined to outer edges of respective corner panels.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE PREFERRED EMBODIMENTS.

Figure 1:
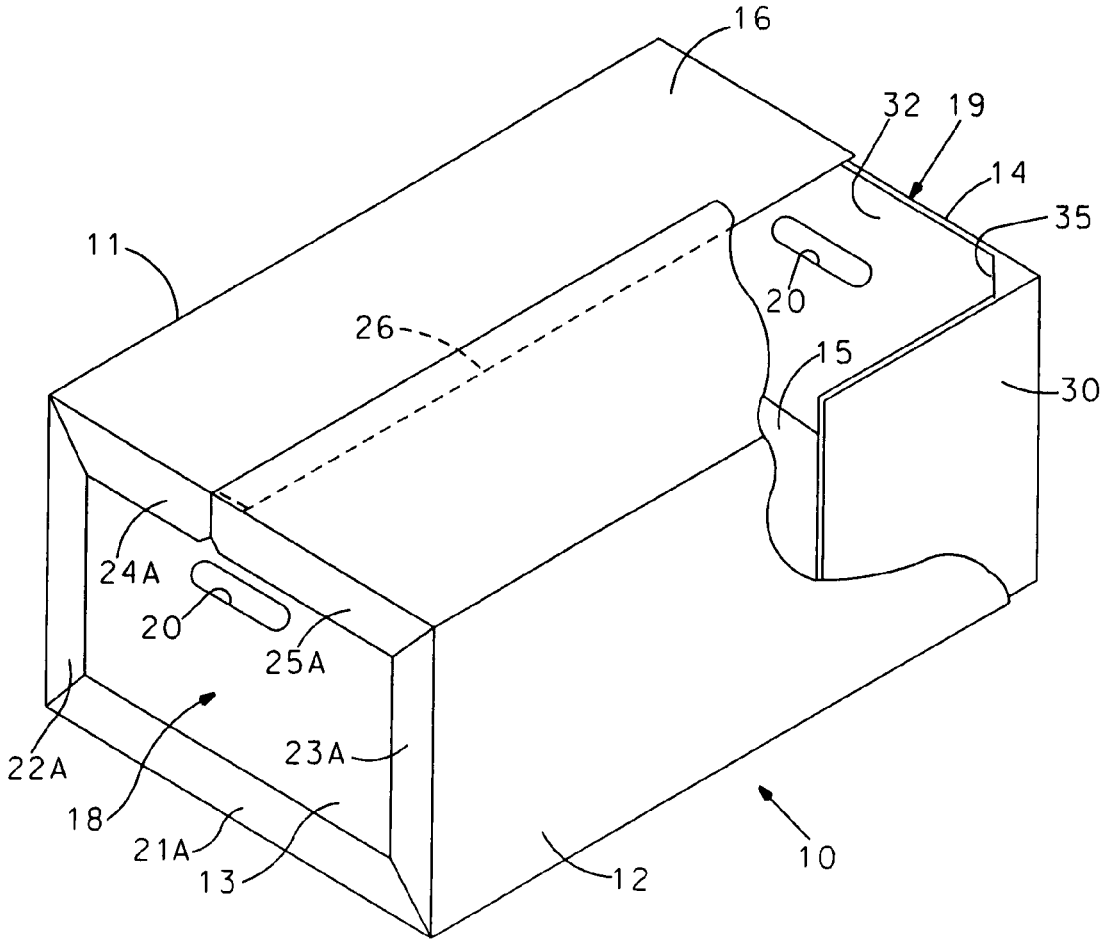
FIG. 1 is a top perspective view of a first form of shipping container in accordance with the invention, with portions broken away to show details.

A first form of three-piece bliss-style shipping container having reinforced corners in accordance with the invention is indicated generally at 10 in FIG. 1. The container 10 has opposite sidewalls 11 and 12, opposite end walls 13 and 14, a bottom wall 15, and a top wall 16, constructed by assembling and gluing together a wrapper 17 and two end pieces 18 and 19 having reinforced corners. Together, the wrapper 17 and end pieces 18 form the sidewalls 11, 12, end walls 13, 14, bottom wall 15 and top wall 16 of the container 10. In the form shown, hand-hole openings 20 are provided in the opposite end walls 13 and 14 to facilitate handling of the container.

Figure 2:
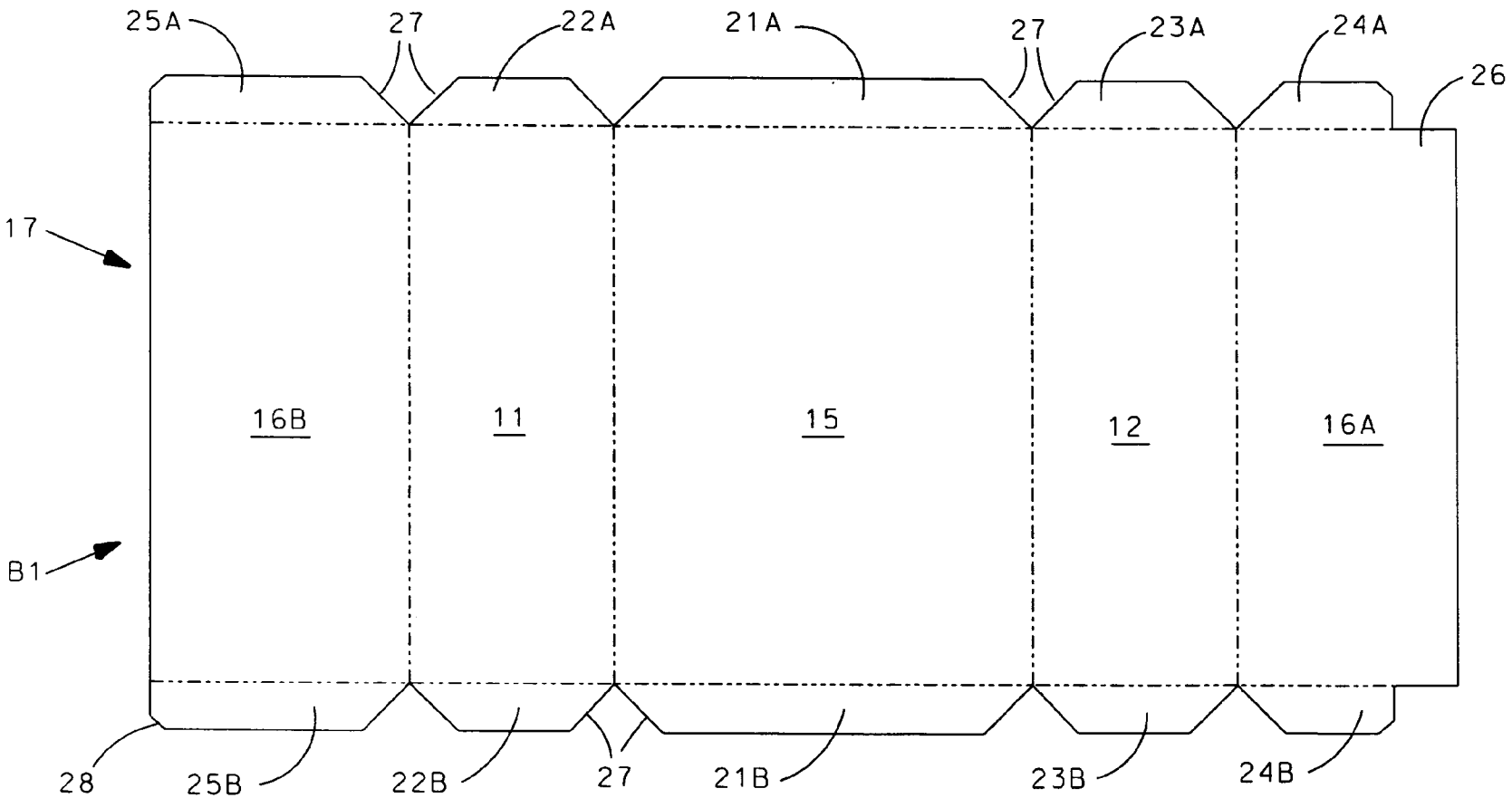
FIG. 2 is a plan view of a blank for making the wrapper that forms the bottom, top and sides of the reinforced three-piece container shown in FIG. 1.

With particular reference to FIG. 2, the wrapper 17 is formed from a single unitary blank B1 having a generally centrally located rectangular panel 15 that forms the bottom wall in the completed container 10. Sidewall forming panels 11 and 12 are foldably joined to opposite side edges of the rectangular panel 15, and top wall panels 16A and 16B are foldably joined, respectively, to edges of the sidewall panels 11 and 12 opposite their folded connection to the rectangular panel 15. Relatively narrow glue flaps or tabs 21A and 21B, 22A and 22B, 23A and 23B, 24A and 24B, and 25A and 25B are foldably joined, respectively, to opposite ends of the rectangular panel 15, the Sidewall forming panels 11 and 12, and the top wall panels 16A and 16B. It will be noted that panel 16B has a slightly greater width than panel 16A, and the glue tabs 24A and 24B do not extend the full width of the panel 16A, but terminate short of the outer free edge thereof, defining a projecting tab 26 on the free edge of panel 16A. Further, adjacent ends of the glue tabs are cut away or mitered at a 45° angle as indicated at 27, and the outer corners of the tabs 24A, 24B and 25A, 25B are mitered as indicated at 28.

Figure 3:
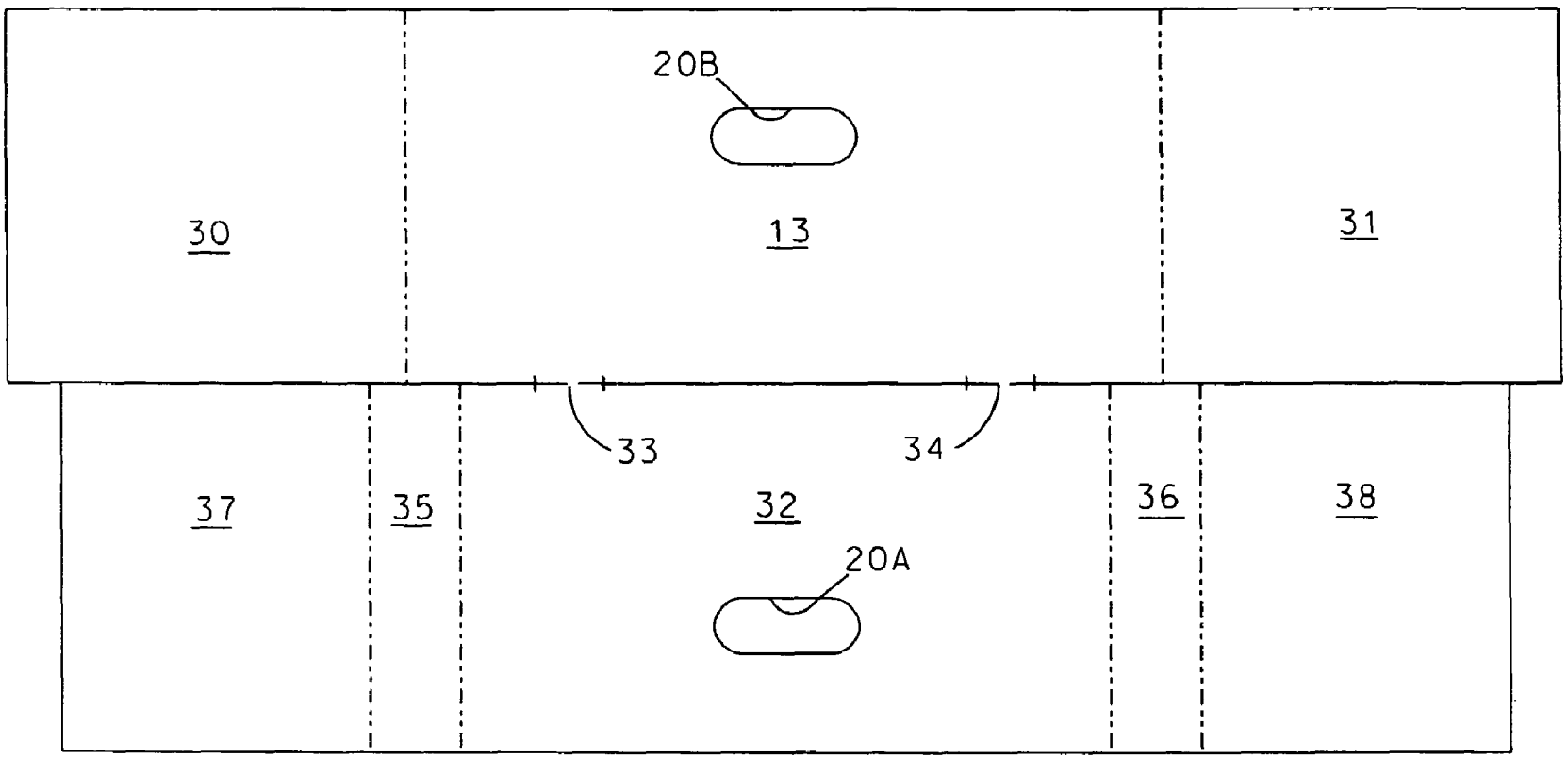
FIG. 3 is a plan view of a blank for making the end pieces used in making the container of FIG. 1.
Figure 4:
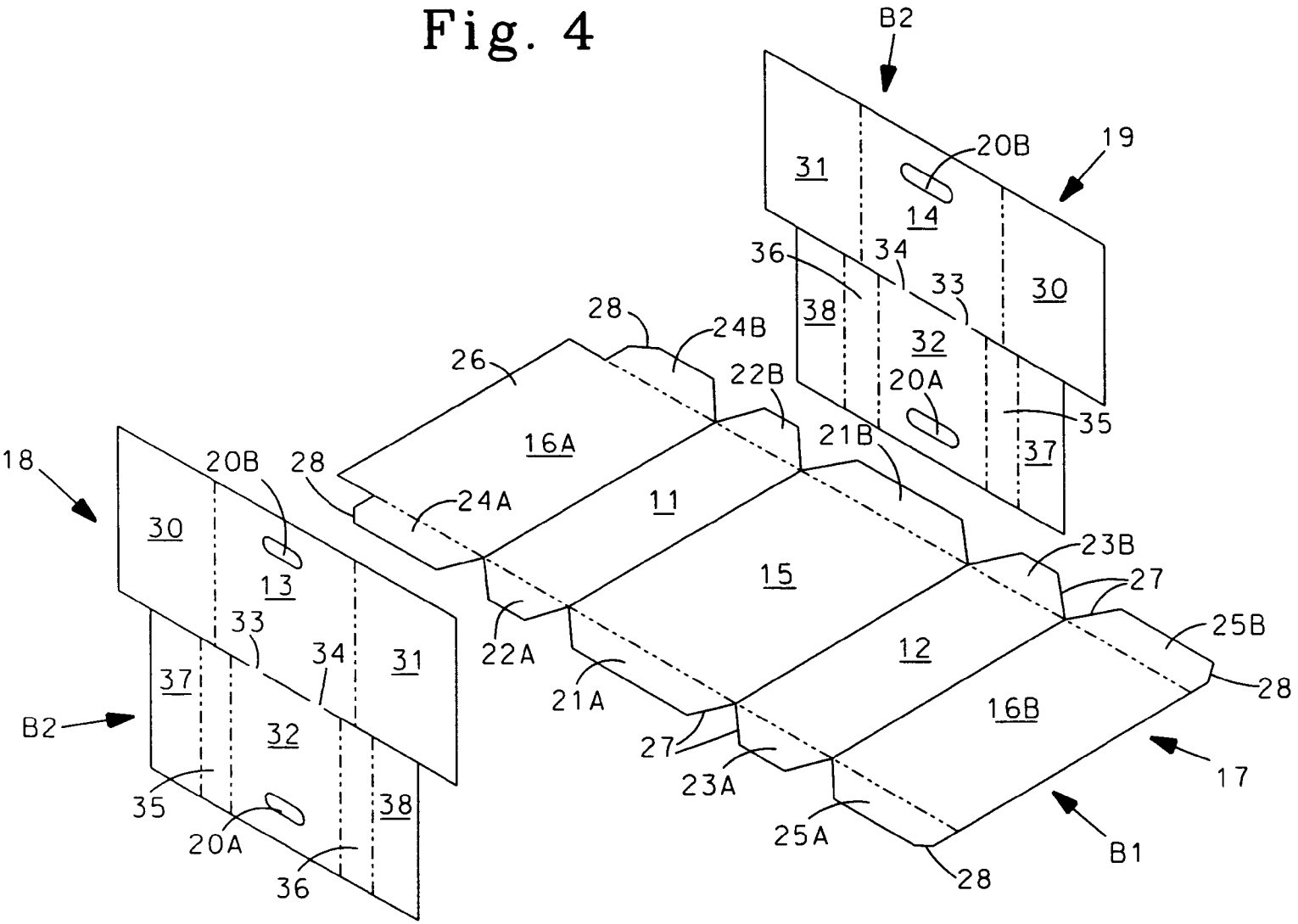
FIG. 4 is an exploded top perspective view showing the blank of FIG. 2 and two of the blanks of FIG. 3 positioned for use in constructing the container of FIG. 1.
Figure 5:
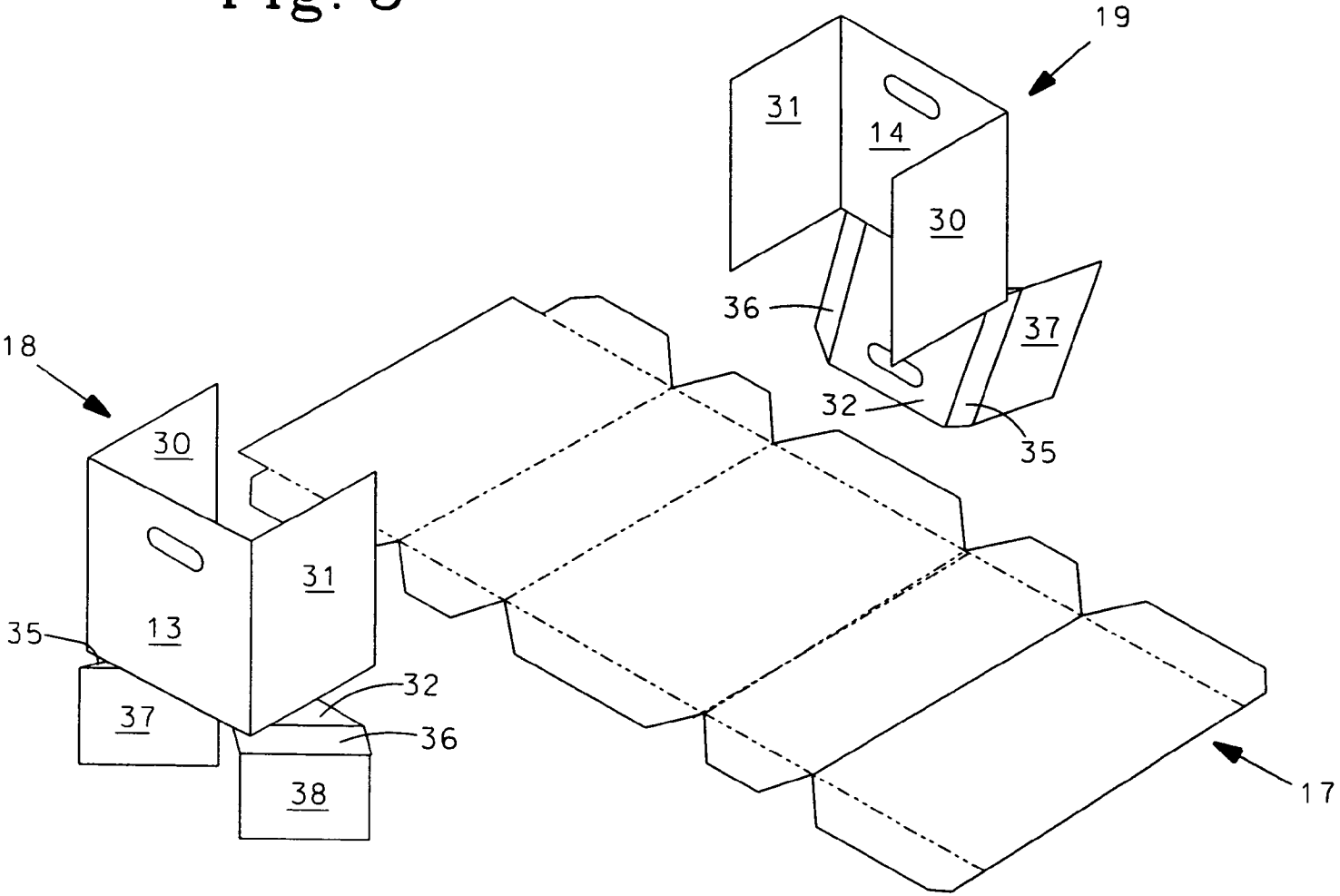
FIG. 5 is an exploded top perspective view of the components of FIG. 4, showing the blanks for the end pieces partially folded into their operative configuration.
Figure 6:
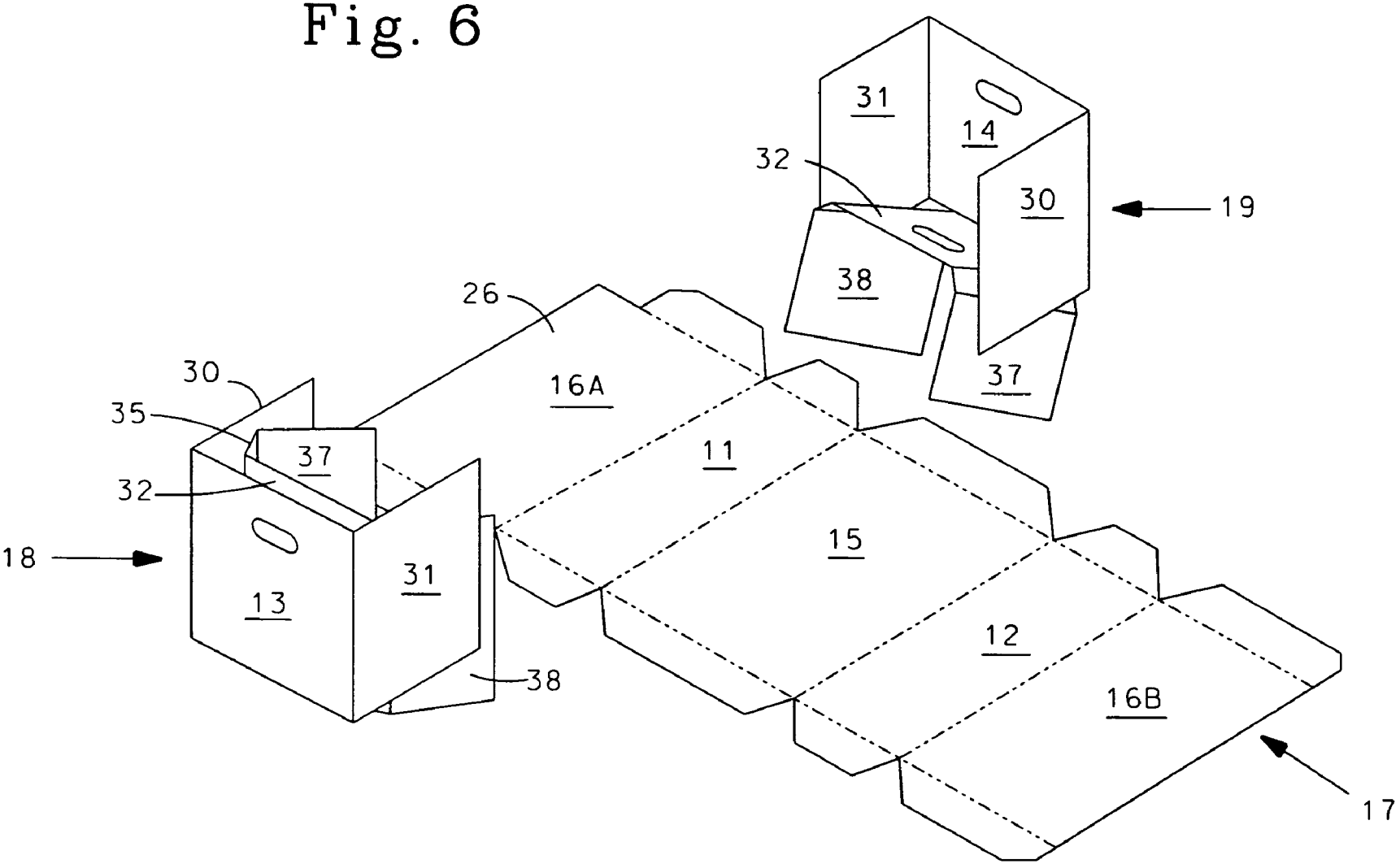
FIG. 6 is a view similar to FIG. 5, depicting the end pieces in a further stage of being folded to their operative configuration.
Figure 7:
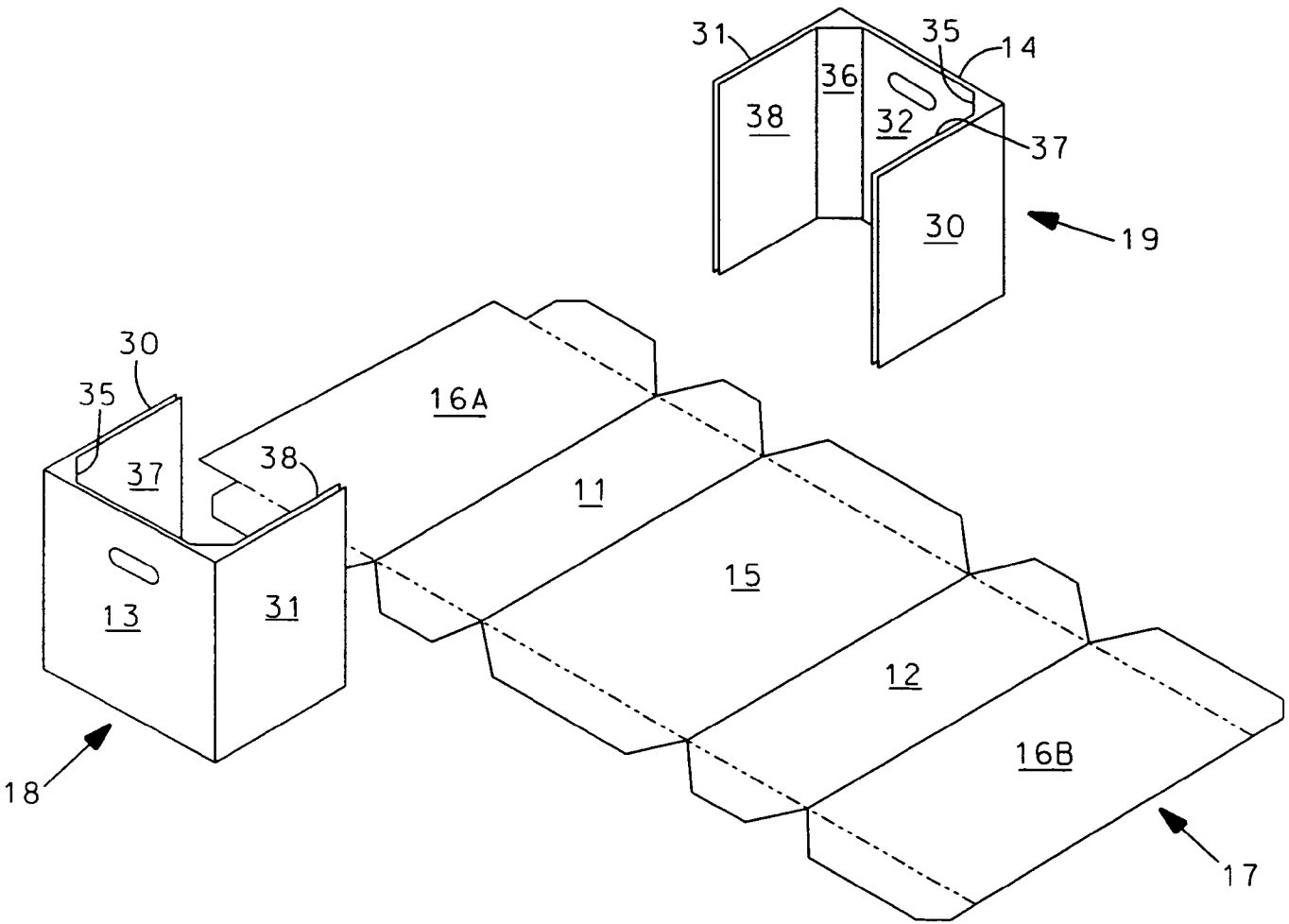
FIG. 7 is a view similar to FIG. 6, depicting the end pieces fully folded into their final operative configuration preparatory to having the wrapper of FIG. 2 applied.
Figure 8:
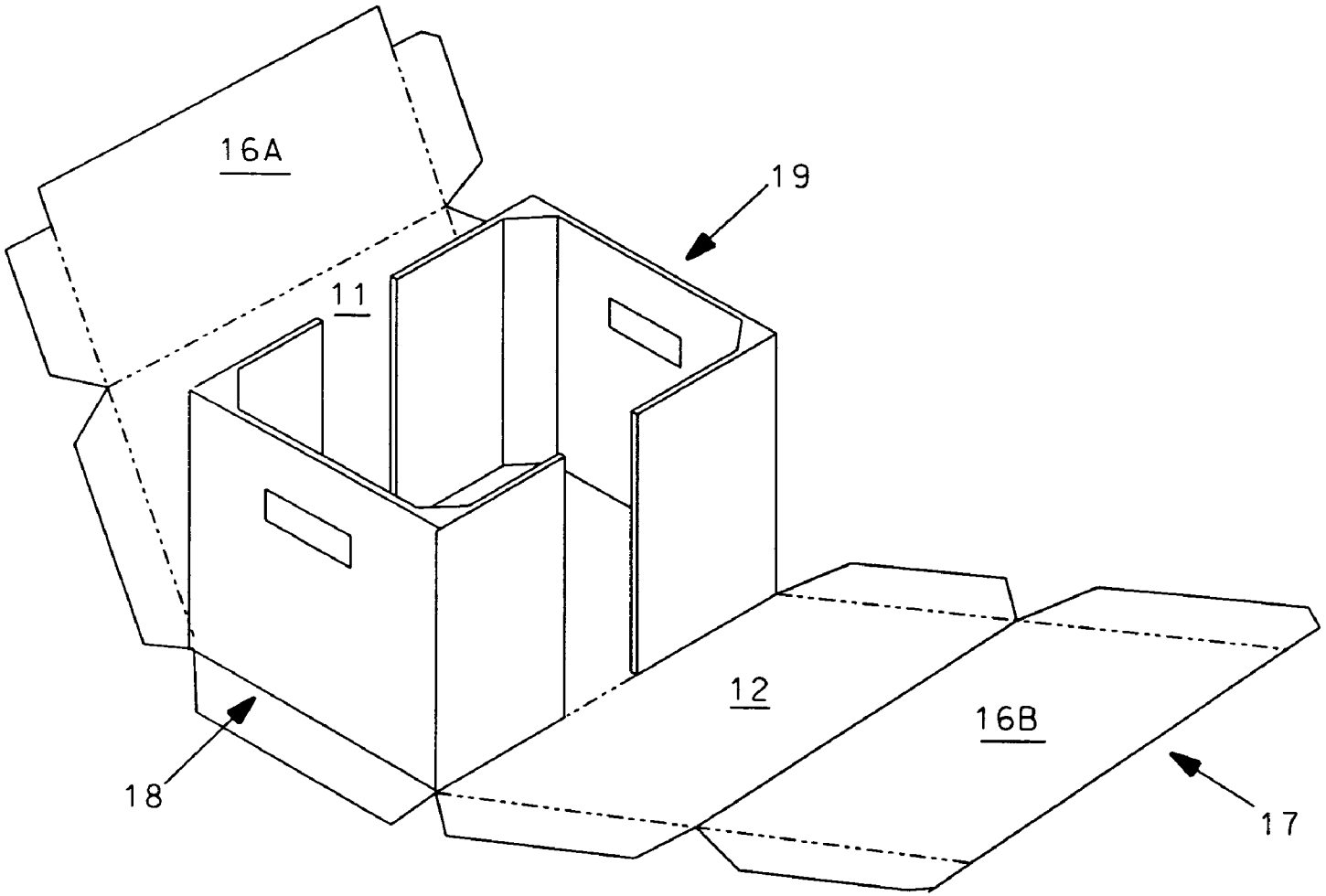
FIG. 8 is a top perspective view of the end pieces located in their operative positions on the wrapper blank, and showing the wrapper blank partially folded into its operative position around the end pieces.

The container end pieces 18 and 19 are essentially identical to one another and only one of the end pieces 18 and 19 will be described in detail. It is understood that description of one applies to both except that as assembled in the container they are mirror images of one another. Thus, and with particular reference to FIG. 3, the container end pieces 18 and 19 are each made from a single unitary blank B2 having an outer end wall panel 13 (another identical blank B2 would form the opposite end wall panel 14). First partial sidewall panels 30 and 31 are foldably joined to opposite ends of the outer end wall panel 13. An inner end wall panel 32 is foldably joined along a bottom edge of the outer end wall panel 13 by a pair of connecting webs 33 and 34 and relatively narrow reinforcing corner panels 35 and 36 are foldably joined to opposite ends of the panel 32. Second partial sidewall panels 37 and 38 are foldably joined to outer edges of respective reinforcing corner panels 35 and 36. Hand hole openings 20A and 20B are formed through the respective inner and outer end wall panels 32 and 13, spaced from but adjacent the free edges of the panels 32 and 13 in positions to be in registry with one another to form the hand hole 20 when the end pieces 18 and 19 are in their fully folded operative configurations.

To assemble the container 10, and as seen best in FIGS. 4-8, partial sidewall panels 30 and 31 are folded inwardly at approximately 90° to the respective end wall panels 13 and 14. Reinforcing corner panels 35 and 36 are folded at about 45° to the end wall panels 32. Sidewall panels 37 and 38 are folded at about 45° to the panels 35 and 36, and panels 32 is folded upwardly and inwardly relative to panels 13, 14 to the position shown in FIG. 7. With the panels 32 lying inside and against the respective panels 13, 14, the second partial sidewall panels 37 and 38 are lying inside and against first partial sidewall panels 30 and 31, respectively, and diagonal corner panels 35 and 36 extend across the interiors of the corners of the end pieces 18 and 19.

Figure 9:
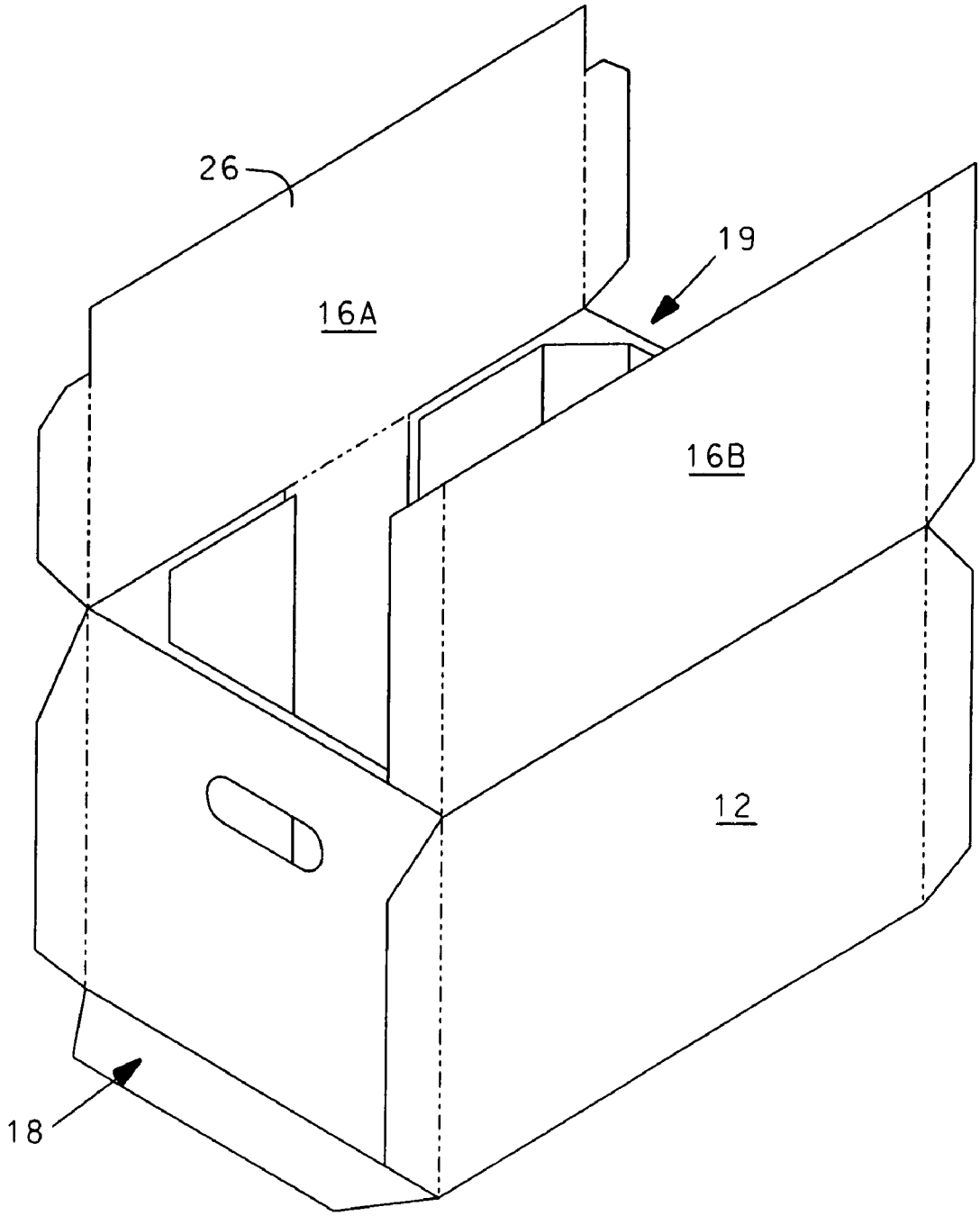
FIG. 9 is a view similar to FIG. 8, showing the wrapper blank folded further toward its operative configuration around the end pieces.
Figure 10:
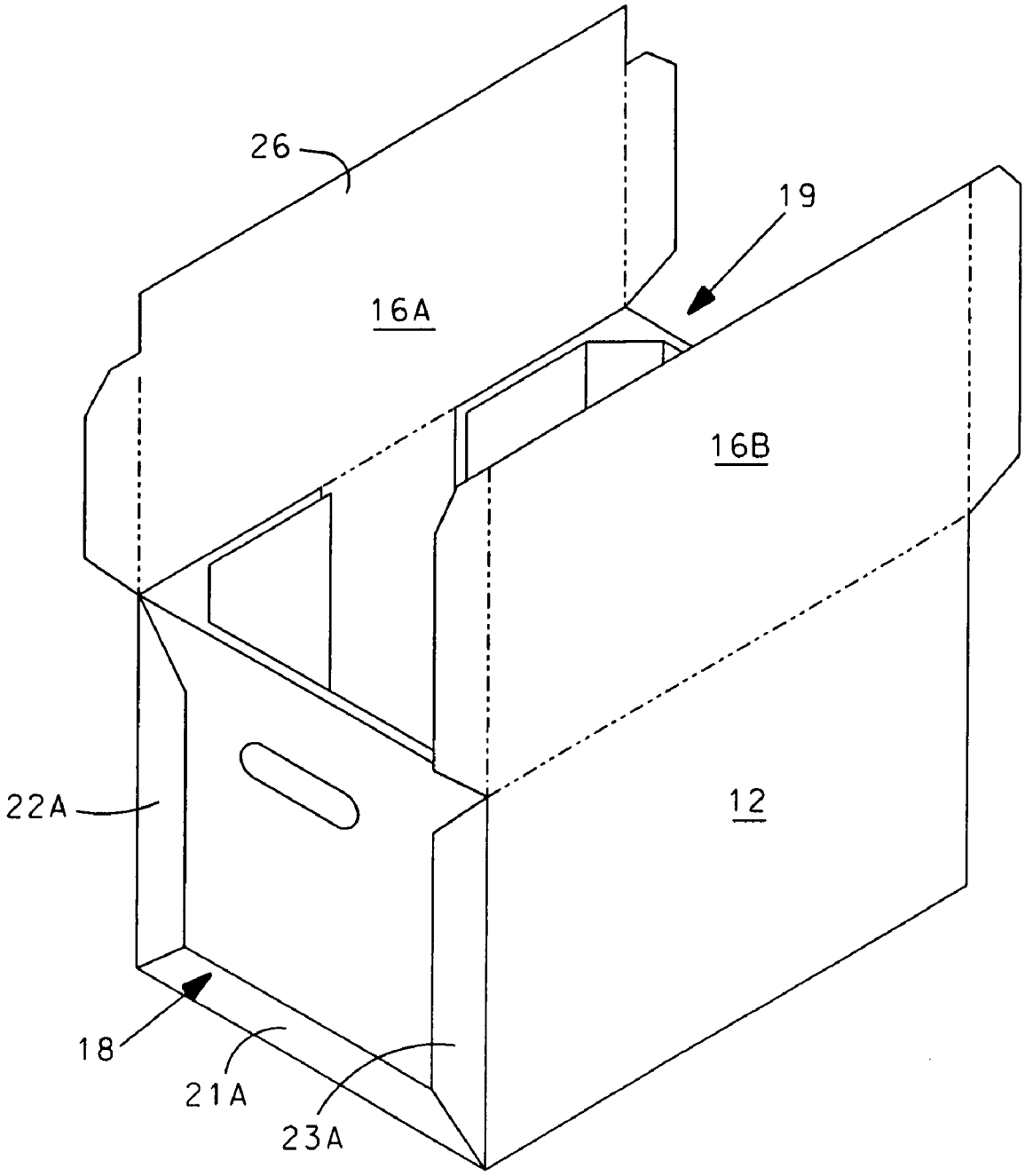
FIG. 10 is a view similar to FIG. 9, showing the wrapper folded and glued against the end pieces to form the bottom and sides of the container.
Figure 11:
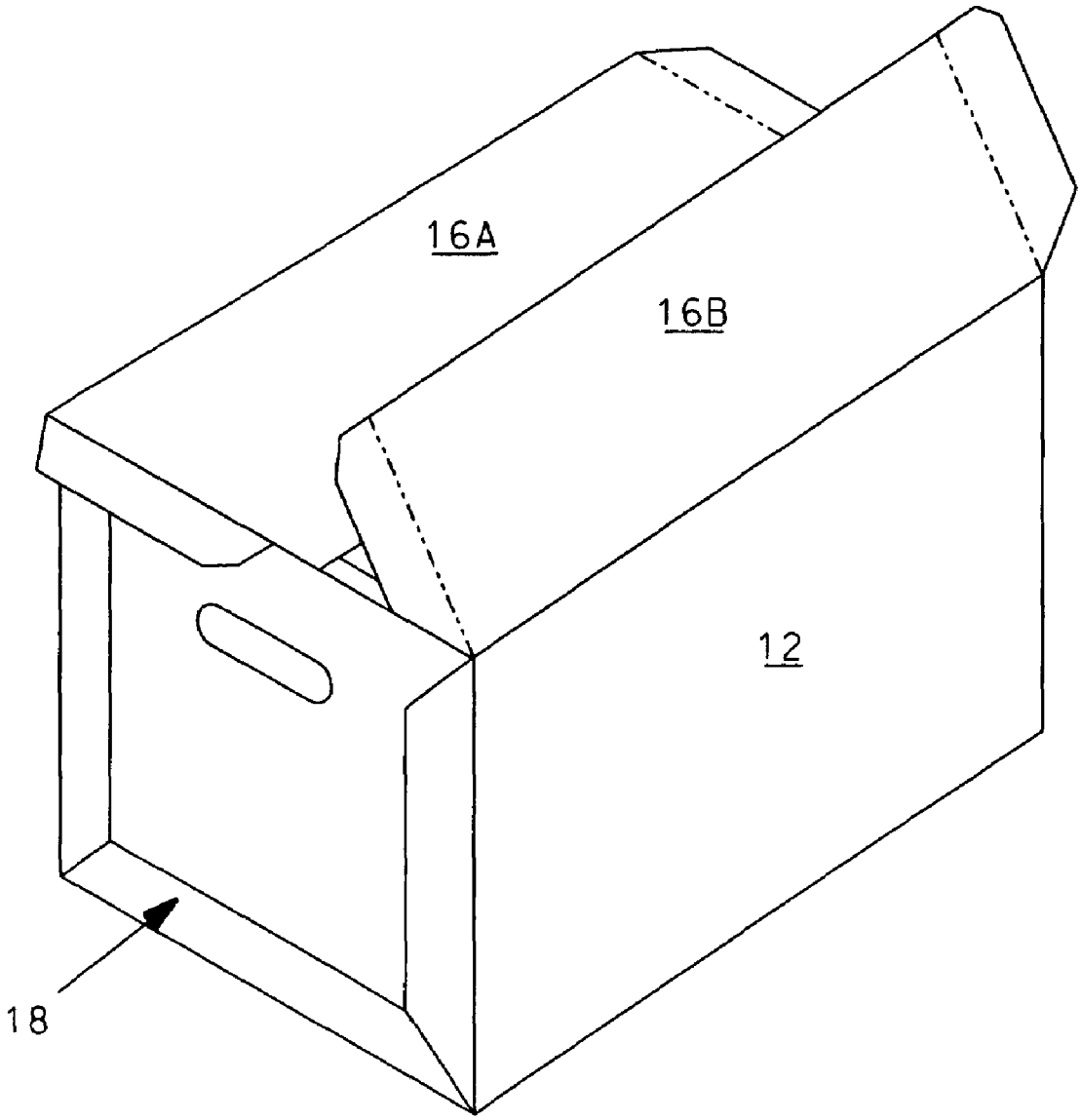
FIG. 11 is a view similar to FIG. 10, showing the wrapper further folded toward its final operative configuration to form a top of the container.

The thus-folded end pieces 18 and 19 are then positioned on the bottom-forming panel 15 of wrapper 17, with the outer end wall panels 13 and 14 aligned with respective opposite end edges of the rectangular panel 15. It will be noted that the inner free edges of first and second partial sidewall panels 30, 31 and 37, 38 do not meet at the middle of the container but terminate short of one another. The panels 11 and 12 of the wrapper are then folded upwardly alongside the partial sidewall panels of the end pieces 18 and 19 as shown in FIG. 9. The glue tabs 21A and 21B, 22A and 22B, and 23A and 23B are then folded against the end wall panels 13 and 14 and adhered thereto as shown in FIG. 10. The top wall panels 16A and 16B are next folded down over the top of the end pieces 18 and 19, with the edge of panel 16B overlying the tab 26 on panel 16A. The glue tabs 24A, 24B and 25A, 25B are then folded down and glued against the respective end wall panels 13 and 14 to form the container as shown in FIG. 1. In a preferred embodiment, the tab 26 is glued to the underside of the panel 16B.

Figure 12:
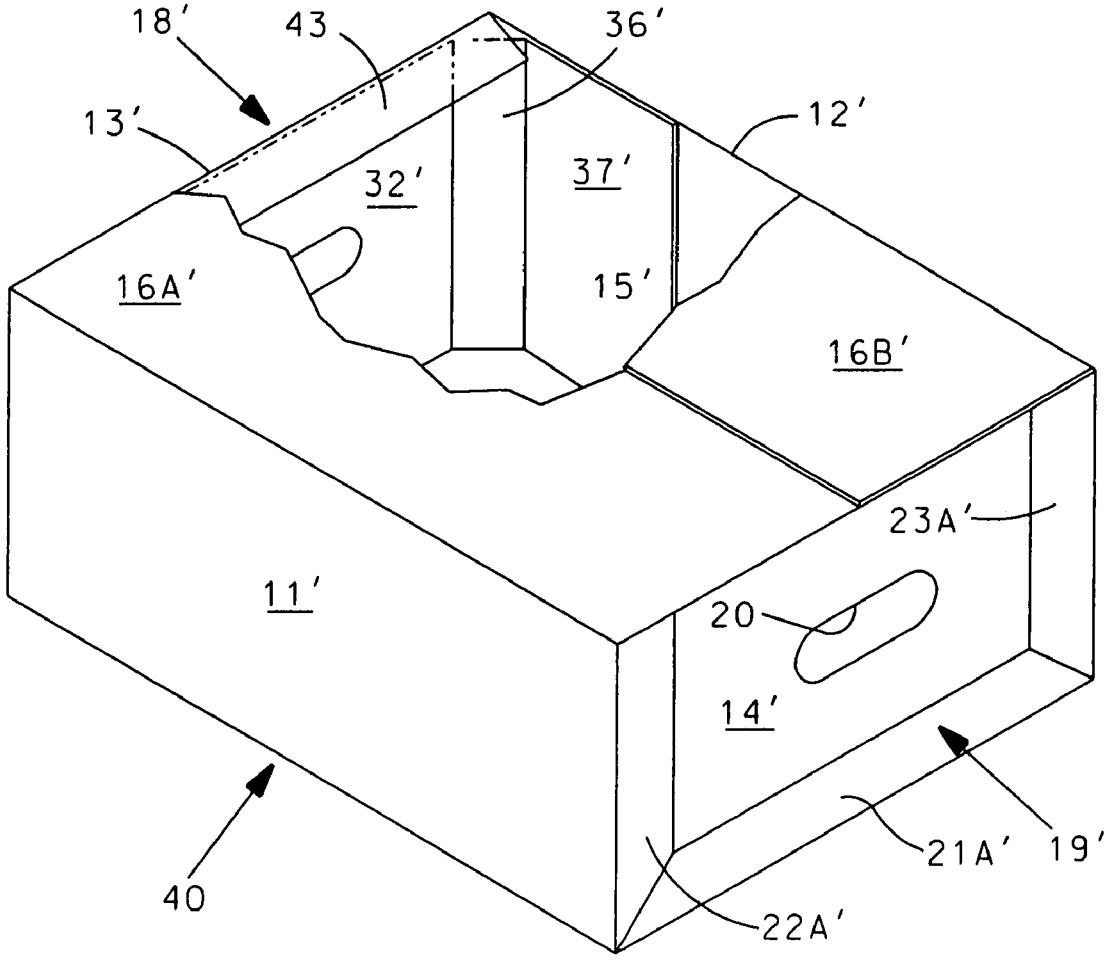
FIG. 12 is a top perspective view of an alternate embodiment of the container of the invention, wherein the end pieces have inwardly folded top flaps.

A second embodiment of a shipping container 40 in accordance with the present invention is shown in FIG. 12. Parts corresponding to those in the first embodiment described above are indicated by corresponding reference characters primed. The second embodiment differs from the first embodiment in that a narrow flap 43 is formed at the top of the end pieces 18' and 19', and the wrapper 17' is modified so that the top panels 16A' and 16B' are glued to the flaps 43 and meet in the middle of the container. The glue tabs 24A, 24B and 25A, 25B of the previous embodiment are omitted, and in lieu thereof top panels 16A' and 16B' are glued to the flaps 43. The glue tabs 22A', 22B' and 23A', 23B' extend to the top of the end wall panels 13' and 14', respectively, and have squared ends 41A, 41B and 42A, 42B, respectively.

Figure 13:
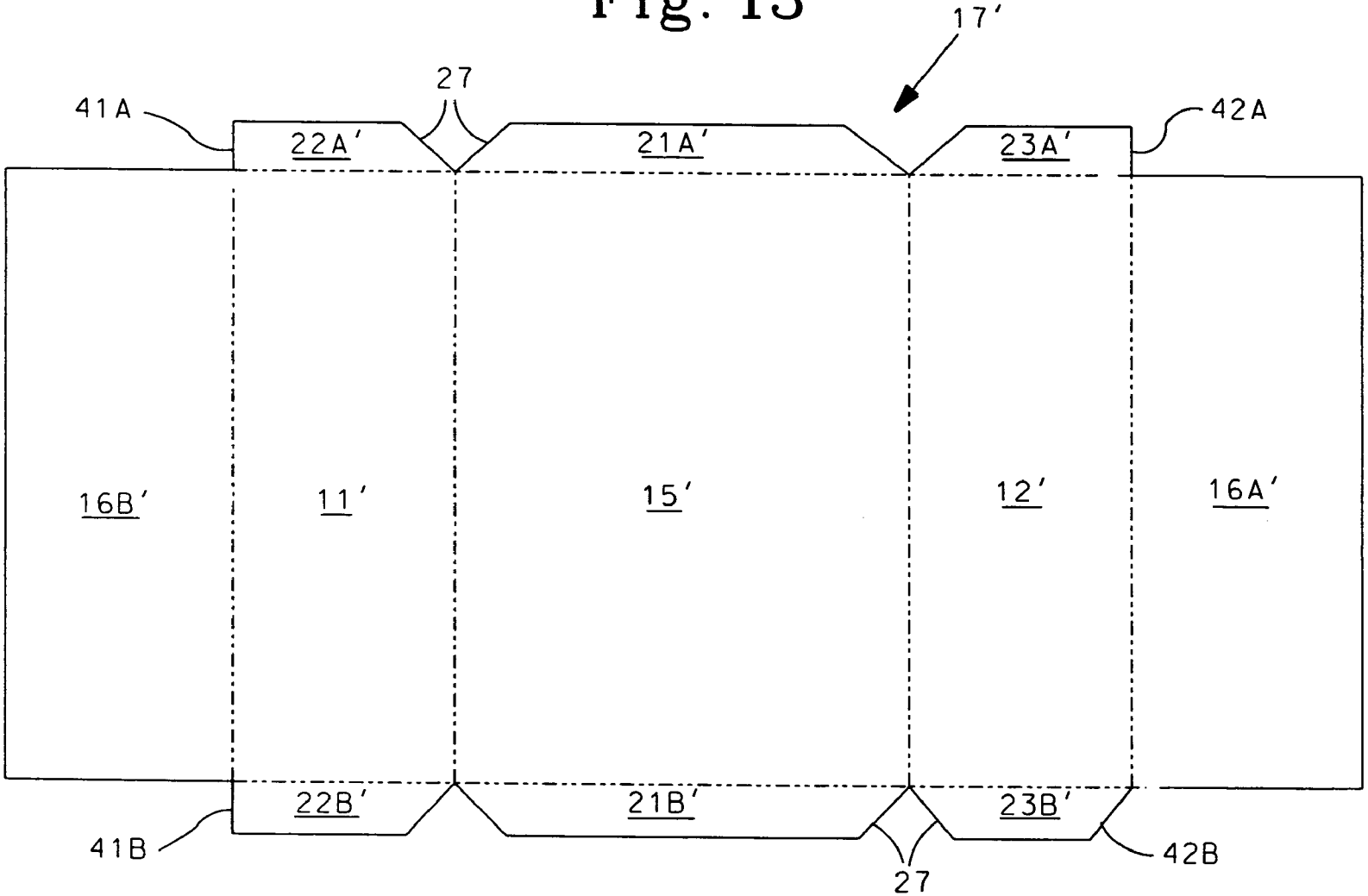
FIG. 13 is a top plan view of a blank for making the wrapper of the container of FIG. 12.

A blank B3 for making the wrapper 17' is shown in FIG. 13, and comprises a bottom panel 15' bordered on opposite sides by sidewall panels 11' and 12', with top wall panels 16B' and 16A' foldably joined to outer edges of the respective sidewall panels 11' and 12'. Glue tabs 21A' and 21B', 22A' and 22B', and 23A' and 23B' are provided, respectively, on opposite ends of the bottom panel 15', the sidewall panels 11' and 12', and the top wall panels 16B' and 16A'. Adjacent ends of the glue tabs 21A', 21B' and 22A', 22B' and 23A', 23B' are mitered at 45° as in the previous embodiment, and the outer ends of glue tabs 22A', 22B' and 23A', 23B' are squared at 41A, 41B and 42A, 42B, respectively.

Figure 14:
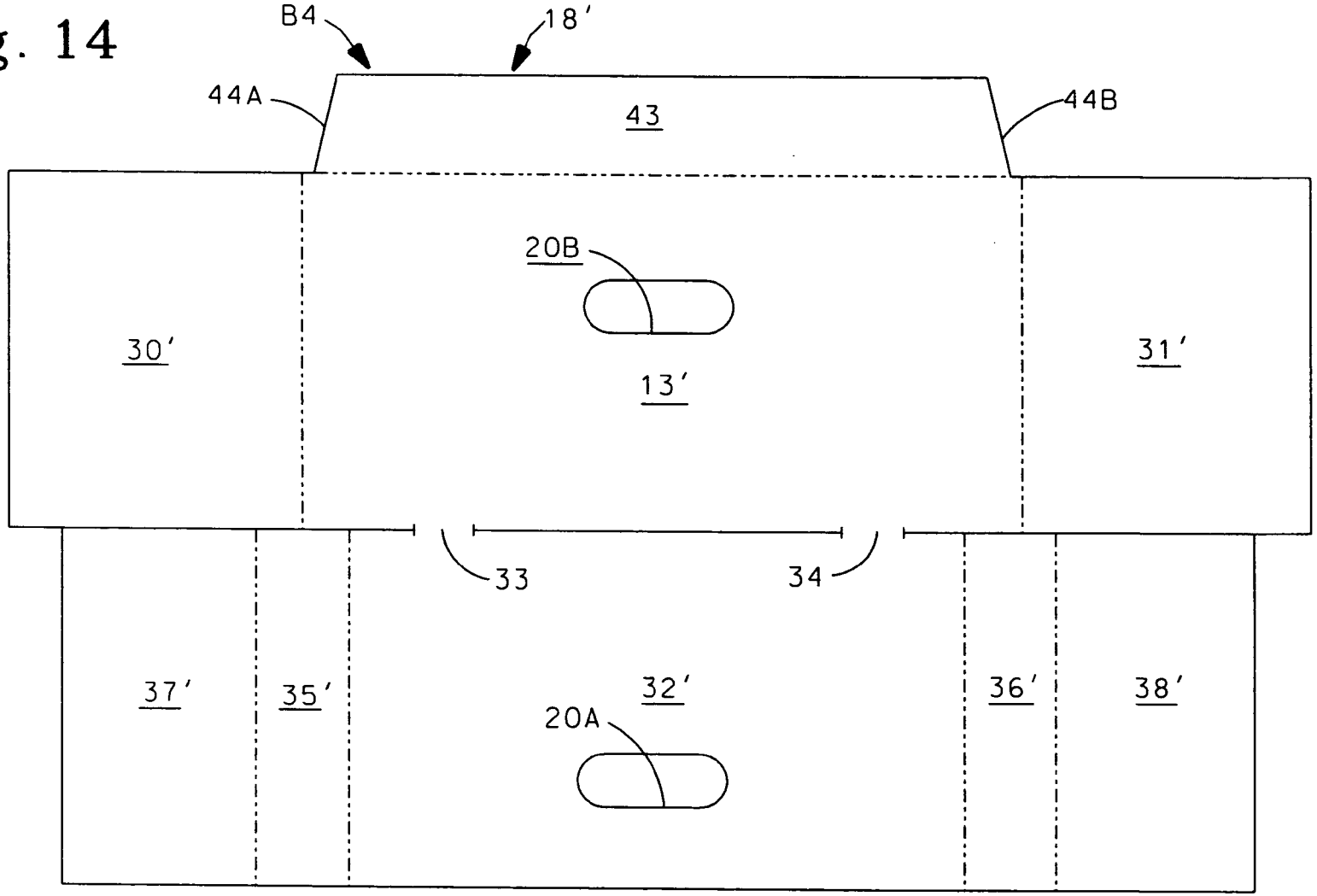
FIG. 14 is a top plan view of a blank for making the end pieces of the container of FIG. 12.
Figure 15:
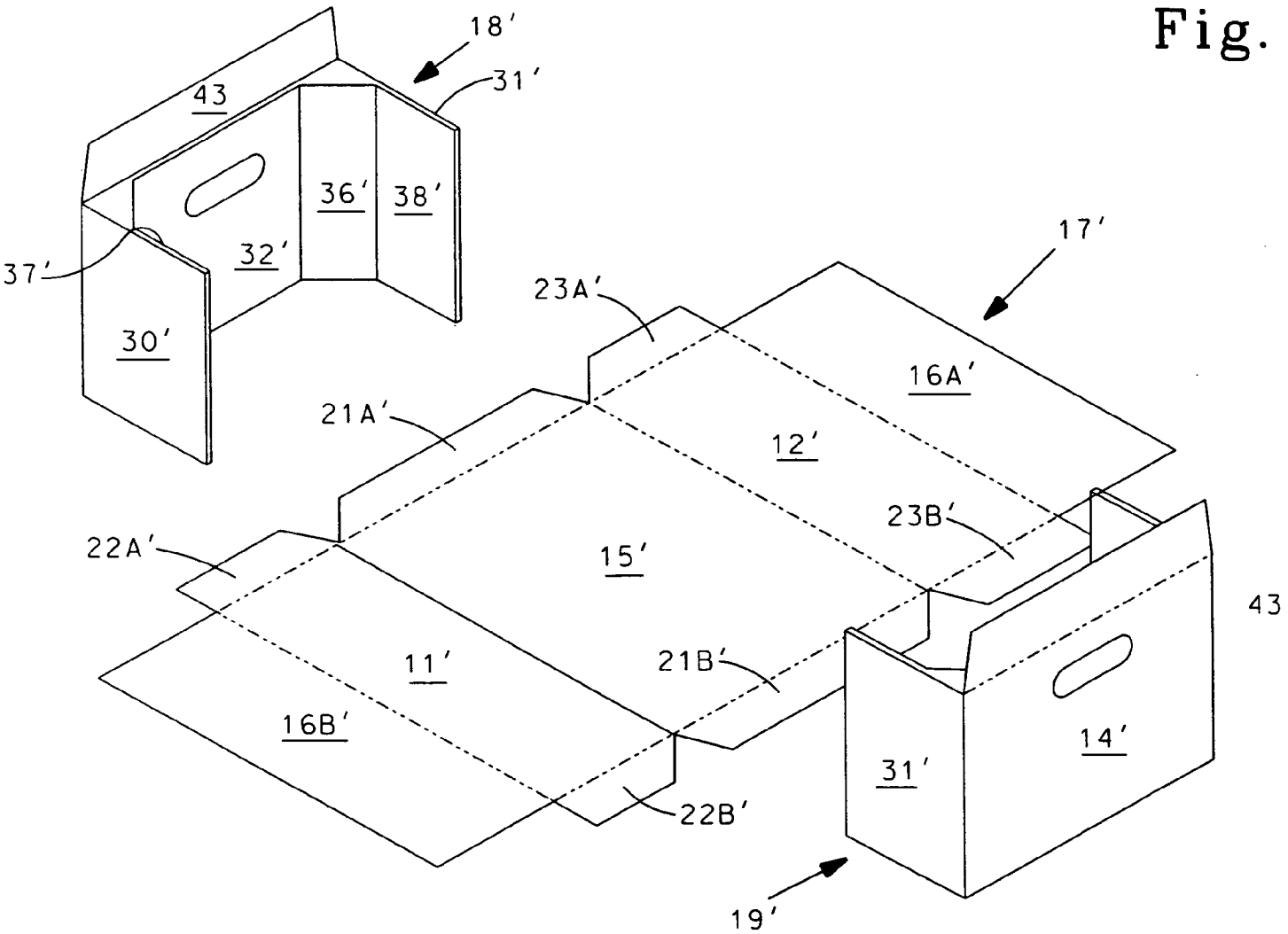
FIG. 15 is an exploded perspective view of the wrapper of FIG. 13 and two of the end pieces of FIG. 14 positioned for assembly after the end pieces have been folded to their operative configuration.
Figure 16:
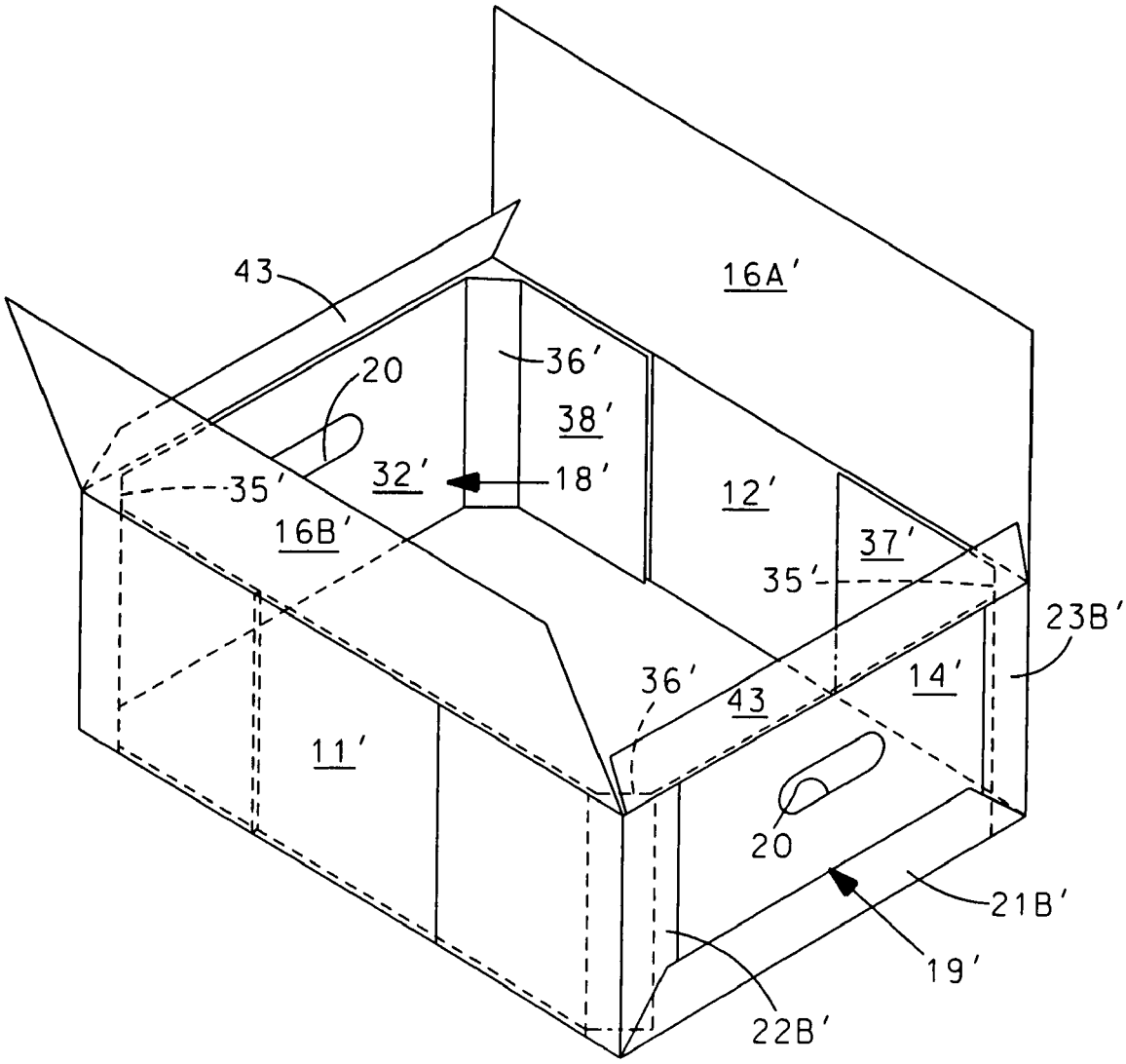
FIG. 16 is a top perspective view of the wrapper and end pieces in partially assembled relationship, with the end piece top flaps and the wrapper top panels being folded into their operative positions.

A blank B4 for making the end pieces 18' and 19' is shown in FIG. 14, and except for the provision of a flap 43 on the upper end of the outer wall panel 13', this form of the invention is the same as the end pieces previously described and will not be described in detail. It is sufficient to note that corresponding parts are indicated by corresponding reference characters primed. The opposite ends of the flap 43 are slightly tapered inwardly at 44A and 44B, respectively.

Assembly of the components is essentially the same as in the previous embodiment, except glue tabs are not provided on opposite ends of the top panels 16A' and 16B', and the top panels are glued instead to the flaps 43, which lie at their opposite ends over the diagonal corner reinforcements 35' and 36'. Additionally, the glue tabs 22A', 22B' and 23A', 23B' extend the full height of the end wall. The end pieces 18' and 19' are placed on the bottom panel 15' of the wrapper 17', and the sidewall panels 11' and 12' folded upwardly alongside the partial sidewall panels 30' and 31' of the end pieces. The glue tabs 21A' and 21B', 22A' and 22B', and 23A' and 23B' are then folded inwardly and glued to the end panels 13' and 14', respectively. The flaps 43 are then folded inwardly, and the top panels 16A' and 16B' are folded down and glued to the flanges 43. The end walls, by extending the full width of the container 40, lend considerable stiffness and rigidity to the box, making it less susceptible to racking when a force is applied unevenly to it.

In both embodiment of the invention, the arrangement results in triple wall thickness in portions of the sidewalls and end walls, full stacking posts are provided in each corner, and the hand holes are reinforced.

A container manufactured as above can be made with automated equipment, and when made and glued up as described, all seams and joints are sealed against the environment.

While the invention has been described with reference to preferred embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A three-piece container having top and bottom walls, opposite end walls, opposite side walls, and reinforced corners, comprising:

a first end piece forming a first said container end wall, the first end piece being folded to define an inner end wall panel and an overlying outer end wall panel, the inner end wall panel being foldably joined to a bottom edge of the outer end wall panel, first partial side wall panels extending perpendicularly from opposite sides of the outer end wall panel, and second partial side wall panels connected to opposite sides of the inner wall panel, the second partial side wall panels extending perpendicularly to the inner end wall panel and lying against an inner surface of said first partial side wall panels;

a second end piece forming a second said container end wall, the second end piece being folded to define an inner end wall panel and an overlying outer end wall panel, the inner end wall panel being foldably joined to a bottom edge of the outer end wall panel, first partial side wall panels extending perpendicularly from opposite sides of the outer end wall panel, and second partial side wall panels connected to opposite sides of the inner wall panel, the second partial side wall panels extending perpendicularly to the inner end wall panel and lying against an inner surface of said first partial side wall panels; and a wrapper joined to the first and second end pieces and forming the top wall, bottom wall, and opposite side walls, the wrapper having a bottom wall panel, side wall panels foldably joined along a bottom edge to respective opposite side edges of the bottom wall panel, top wall panels foldably joined to respective top edges of the side wall panels and extending inwardly over the top of the container, and narrow flaps foldably joined to ends of the bottom wall panel, side wall panels, and top wall panels, the flap being attached to marginal edges of the outer end wall panels to hold the container assembled, and the wrapper overlying the partial side wall panels to define a triple wall side wall construction.

2. The three-piece container of claim 1, wherein each of the respective second partial side wall panels is joined to the respective inner end wall panels by a diagonal web that forms a reinforcing corner post in each corner of the container.

3. The three-piece container of claim 1, wherein the flaps on the wrapper are folded over and glued to the first and second end pieces.

4. The three-piece container of claim 1, wherein the first and second end pieces and the wrapper are each made from a single unitary blank.

5. The three-piece container of claim 3, wherein the first and second end pieces and the wrapper are each made from a single unitary blank and the flaps are glued to an outside surface of the outer end wall panels of the first and second end pieces.

6. The three-piece container of claim 2, wherein each of the first partial side wall panels and the corresponding outer end wall panel form a first right angle corner spaced outwardly from an adjacent the diagonal web.

7. The three-piece container of claim 6, wherein the wrapper and the flaps form a second right angle corner adjacent and spaced outwardly from said first right angle corner.

8. The three-piece container of claim 1, further comprising a pair of hand hole openings formed into each of the container end walls.

* * * * *